US008337667B2

(12) United States Patent
Johnson et al.

(10) Patent No.: US 8,337,667 B2
(45) Date of Patent: Dec. 25, 2012

(54) SYSTEMS AND METHODS FOR PROVIDING IMPROVED DEWATERING PERFORMANCE IN A PAPERMAKING MACHINE

(75) Inventors: Robert P. Johnson, Sutton, MA (US); David Leeman, Worcester, MA (US); Allen J. Brauns, Sturbridge, MA (US)

(73) Assignee: Kadant, Inc., Westford, MA (US)

( * ) Notice: Subject to any disclaimer, the term of this patent is extended or adjusted under 35 U.S.C. 154(b) by 30 days.

(21) Appl. No.: 12/693,033

(22) Filed: Jan. 25, 2010

(65) Prior Publication Data

US 2010/0186770 A1 Jul. 29, 2010

Related U.S. Application Data

(60) Provisional application No. 61/146,885, filed on Jan. 23, 2009.

(51) Int. Cl.
*D21F 1/32* (2006.01)

(52) U.S. Cl. ..... 162/199; 162/272; 162/281

(58) Field of Classification Search ..... 162/199, 162/272, 281, 358.1–358.5, 361, 363, 367, 162/373; 118/70, 413; 15/236.01, 256.51, 15/301, 303, 309.1, 312.1
See application file for complete search history.

(56) References Cited

U.S. PATENT DOCUMENTS

| | | | | |
|---|---|---|---|---|
| 2,352,220 | A * | 6/1944 | Overton | 34/392 |
| 3,010,134 | A * | 11/1961 | Goyette | 15/257.01 |
| 3,264,673 | A * | 8/1966 | Scott | 15/308 |
| 3,624,860 | A * | 12/1971 | Grimston et al. | 15/308 |
| 4,185,399 | A * | 1/1980 | Gladish | 34/120 |
| 4,700,493 | A | 10/1987 | Wedel et al. | |
| 4,953,252 | A | 9/1990 | Akisawa | |
| 5,021,124 | A | 6/1991 | Turtinen et al. | |
| 5,597,449 | A | 1/1997 | Vestola et al. | |
| 5,657,693 | A | 8/1997 | Kumaki et al. | |
| 6,139,638 | A | 10/2000 | Dubois et al. | |
| 6,386,106 | B1 | 5/2002 | Stanka | |
| 6,447,646 | B1 | 9/2002 | Hassinen et al. | |
| 6,491,791 | B1 * | 12/2002 | Loippo | 162/199 |
| 6,687,950 | B1 * | 2/2004 | Rata et al. | 15/256.51 |
| 6,942,734 | B2 | 9/2005 | Rata et al. | |
| 2005/0098292 | A1 * | 5/2005 | Ried et al. | 162/281 |
| 2006/0054293 | A1 | 3/2006 | Strauch | |
| 2006/0180291 | A1 | 8/2006 | Rata | |
| 2006/0289141 | A1 | 12/2006 | Rata et al. | |

FOREIGN PATENT DOCUMENTS

| | | |
|---|---|---|
| DE | 4108167 A1 | 9/1992 |
| WO | WO 99/37856 | 7/1999 |
| WO | WO 2009/108754 | 9/2009 |

* cited by examiner

*Primary Examiner* — Mark Halpern
(74) *Attorney, Agent, or Firm* — Gesmer Updegove LLP

(57) ABSTRACT

A doctoring system is disclosed for cleaning a moving surface in a papermaking machine, and the doctoring system includes a doctor blade and fluid assist system. The doctor blade is coupled to a doctor blade holder, and the doctor blade holder is coupled to a doctor-back. The fluid assist system is for providing a fluid under positive pressure that is higher than atmospheric pressure. The fluid is directed in a direction generally opposite a direction of movement of the moving surface such that fluid of high momentum is provided to impinge on water resident within the moving surface and adjacent a leading edge of the doctor blade during movement of the moving surface.

40 Claims, 10 Drawing Sheets

SYSTEMS AND METHODS FOR PROVIDING IMPROVED DEWATERING PERFORMANCE IN A PAPERMAKING MACHINE

PRIORITY

This application claims priority to U.S. Ser. No. 61/146,885 filed Jan. 23, 2009, the disclosure of which is hereby incorporated in its entirety.

BACKGROUND

1. Field of the Invention

This invention relates to doctor blade systems, and is concerned in particular with an improved design that facilitates water or debris removal performance while maintaining desired doctor blade holder performance.

2. Description of the Prior Art

Many roll cleaning and sheet shedding applications on paper machines and other web handling applications involve doctor blade support devices commonly referred to as doctor blade holders. Typically, a doctor blade holder is mounted on a doctor-back, which is a heavy-duty beam that spans the paper machine width. The rear portion of a doctor blade is received into the holder, which supports the blade in a predetermined position relative to a surface to be cleaned. The doctor blade holder works in concert with the doctoring assembly to apply the working edge of the blade, found on the blade's front portion, to an adjacent moving surface.

Certain conventional doctoring apparatus for paper machines are equipped with double doctors; the primary doctor cleans the surface of the roll, while the secondary blade carries away water and debris that may have dislodged from machined features such as holes and/or grooves in the roll surface, typically under affect of centrifugal force, with some additional influence from a reduction in fluid surface tension. This is, however, often not sufficient to adequately dewater the rolls.

U.S. Pat. No. 6,491,791 discloses a method and apparatus to clean roll surfaces or fabrics used in papermaking machines, wherein a doctoring element includes one or two integral doctor blades as well as an integral gas chamber that provides pressurized gas, e.g., compressed air, to the outgoing side of a doctoring apparatus having one doctor blade, and to the inter-blade area of a doctoring apparatus having two doctor blades. The compressed air is provided to enhance the water or dirt removal capabilities. Each of the disclosed apparatus involves doctor blades that are integral with the structure forming the gas chamber within the doctoring element. The apparatus including a two blade doctoring element, for example, provides that the interblade space forms a closely and tightly delineated pocket into which compressed air may be passed ('791 patent, col. 3, lines 18-20). The high pressure compressed air is disclosed to escape under the doctor blades via grooves on the grooved-shell roll being processed ('791 patent, col. 6, lines 59-63).

The use of such integral doctor blades requires that the entire doctoring element be replaced whenever the doctor blades become too worn. The doctoring apparatus are also not disclosed to be position adjustable with respect to the roll, and it is not at all clear how such an integral gas chamber may be incorporated in a doctoring apparatus that provides adjustable position accuracy with respect to a roll as well as flexibility in doctoring a roll along an elongated length of the doctor blade. Further shortcomings of such systems include: 1) The apparatus is not integral with the holder. 2) The apparatus is part of the blade and thus when it is worn or damaged it must be replaced, which is very costly. 3) The apparatus is very rigid and lacks the ability to conform well to the roll surface. 4) The air discharge features and geometry used for the purpose of dewatering can fail to produce adequate dewatering. 5) The apparatus air discharge is always open allowing contaminants to enter from the ambient when the device is not pressurized; the ingress of contaminants may be avoided by applying pressurized air when the machine is under maintenance, but with the disadvantage of the added cost associated with it.

U.S. Pat. No. 6,139,638 discloses a doctor blade holder apparatus that includes a planar upper holding member that is pivotally mounted to a tray such that the position of the upper holding member with respect to the tray may be adjusted by unloading and loading tubes. The upper holding member also includes a plurality of distribution passages that are coupled respectively off of the upper holding member via a plurality of branch conduits to a common header. The pressurized fluid, therefore, must separately travel through the conduits to reach each of the individual areas along the doctor blade holder apparatus, while maintaining sufficiently equalized pressure as the fluid is directed toward the roll along the elongated length of the doctor blade.

There remains a need, therefore, for a cost effective doctor blade holder system that facilitates consistent debris removal without limiting the flexibility of the doctor blade holder system or the effectiveness of the doctoring process, and in particular that improves the dewatering performance of a doctor apparatus operating on various paper machine rolls, while retaining or improving the cleaning performance of the doctor blade, such as, for example in a machine for doctoring a paper machine suction press.

SUMMARY

In accordance with an embodiment, the invention provides a doctoring system for cleaning a surface in a papermaking machine, and the doctoring system includes a doctor blade and fluid assist system. The doctor blade is coupled to a doctor blade holder, and the doctor blade holder is coupled to a doctor-back. The fluid assist system is for providing a fluid under positive pressure that is higher than atmospheric pressure. The fluid is directed in a direction generally opposite a direction of movement of the moving surface such that fluid of high momentum is provided to impinge on water resident within the moving surface and adjacent a leading edge of the doctor blade during movement of the moving surface.

In accordance with another embodiment, the system includes a doctor blade and a fluid securing system for providing a fluid within a plenum under positive pressure that is higher than atmospheric pressure, to utilize plenum pressure to position and stabilize the doctor blade into a fixed position against surfaces of the doctor blade holder.

In accordance with another embodiment, the invention provides a method of cleaning a moving surface in a papermaking system. The method includes the steps of coupling a doctor blade to a doctor blade holder and coupling said doctor blade holder to a doctor-back, and providing a fluid within a plenum under positive pressure that is higher than atmospheric pressure, to utilize plenum pressure to position and stabilize the doctor blade into a fixed position against surfaces of the doctor blade holder, while also directing the fluid under positive pressure in a direction generally opposite a direction of movement of the moving surface such that fluid of high momentum is provided to impinge on water resident within the moving surface and adjacent a leading edge of the doctor blade during movement of the moving surface.

BRIEF DESCRIPTION OF THE DRAWINGS

The following description may be further understood with reference to the accompanying drawings in which.

The drawings are shown for illustrative purposes only and are not necessarily to scale.

DETAILED DESCRIPTION OF THE DRAWINGS

The present invention provides an improved doctoring device for dewatering paper machine rolls, such as press rolls, in which machined features in the roll such as grooves and through holes or blind holes carry away unwanted water that needs to be removed. The doctoring device includes several features that comprise the dewatering capability. The flexibility of the doctoring device is retained by (1) making the dewatering features integral with the holder loading features; this is accomplished through use of fiber reinforced pultrusion, or metallic extrusion, and (2) retaining a separate doctor blade component.

The device may include a plurality of mounting structures that are integrally formed as a result of the pultrusion or extrusion process. Further, the conventional doctor blade wear commodity item is retained for cleaning the roll surface, and it remains as a separate low cost consumable component. The holder proper with dewatering features then never requires replacement due to wear. Air would be suitable for most applications, although systems of various embodiments of the invention device are also suitable for use with other fluids such as steam, or even liquids.

Figure 1:
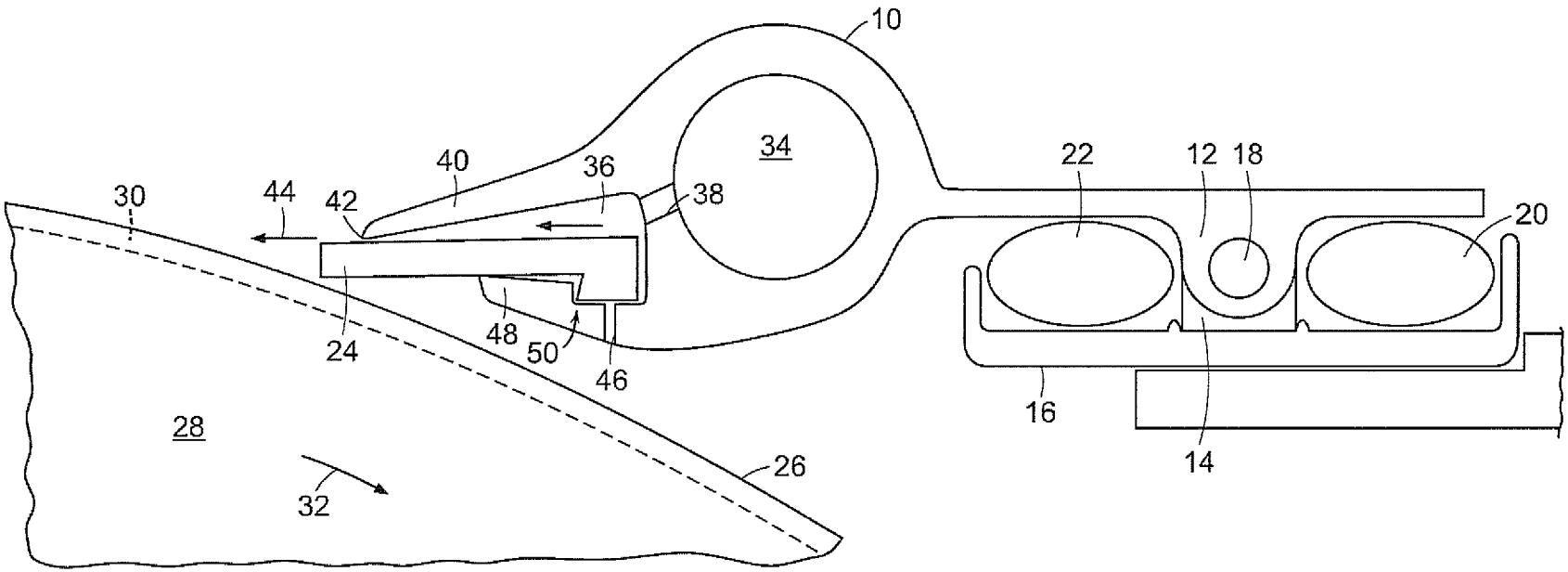
FIG. 1 shows an illustrative diagrammatic view of a doctoring system in accordance with an embodiment of the invention.

In accordance with an embodiment, the invention provides a mechanical and flow device assembly that is used for doctoring paper machine rolls that carry, for example, water. FIG. 1 shows an embodiment of the invention wherein a doctor blade holder 10 with integral mounting structure 12 is pivotally attached to a tube tray 16. The mounting structure engages with mounting structure 14 on the tube tray 16 and a rod 18 is used to secure the doctor blade holder 10 to the tube tray 16. The mounting structure 12 may be provided as a single elongated form that extends along the elongated length of the doctor blade holder, or may include multiple spaced apart structures that align with multiple spaced apart mounting structures on the tube tray 16. The position of the doctor blade holder 12 with respect to the tube tray 16 is controlled by a loading tube 20 that applies a doctor blade 24 to a surface 26 of a roll 28 and an unloading tube 22 that removes the doctor blade 24 from the surface 26 of the roll 28 (herein both generally referred to as loading tubes) through application and removal of a fluid into and from the respective loading tubes 20, 22. The surface 26 of the roll 28 may include machined features such as grooves 30 in which water collects and from which the water needs to be evacuated by the dewatering system. During use, the roll 28 rotates in a direction as generally indicated at 32.

The doctor blade holder 10 also includes an integral flow plenum 34, and carries the separate doctor blade 24 that doctors the grooved surface 26. The doctor blade holder 10 may be a fiber reinforced pultrusion or metallic extrusion. Air under pressure enters the plenum 34, and then feeds into intermediate plenum 36 through aperture 38. The aperture 38 may comprise either a series of holes or a continuous slot opening. The escaping air under pressure travels between the top of the doctor blade 24 and the underside of the front portion 40 of the doctor blade holder 10, and is directed out an exit 42 toward the grooved surface of the roll as shown at 42. In the absence of pressure, a gap at the exit 42 is closed, preventing contaminants from entering during a machine outage.

During use, the pressure within the intermediate plenum 36 exerts an upward force on forward portion 40 of the holder 10, urging region the portion 40 upward thereby creating the gap at the exit 42. Air flows in the direction of the exit gap 42, which is typically 0.005 inches-0.015 inches if air is used as the fluid. In accordance with other embodiments, other fluids including gasses or even liquids may be used. The portion 40 of the doctor blade holder 10 may be configured with a less stiff fiber lay-up than the remaining portions of the holder 10, ensuring that regions other than region 40 remain relatively undeflected. A properly designed fiber lay-up will deflect a predetermined amount for proper operation and functionality. A communication port 46 at the underside of the doctor blade holder 10 proximate the intermediate plenum 36 ensures that a net downward force will be provided by the blade 24 against region 48 of the doctor blade holder 10. This holds the blade 24 in a stable manner within the holder 10. The blade 24 is also stabilized by having a wedge-shaped geometry as shown at 50.

Figure 2:
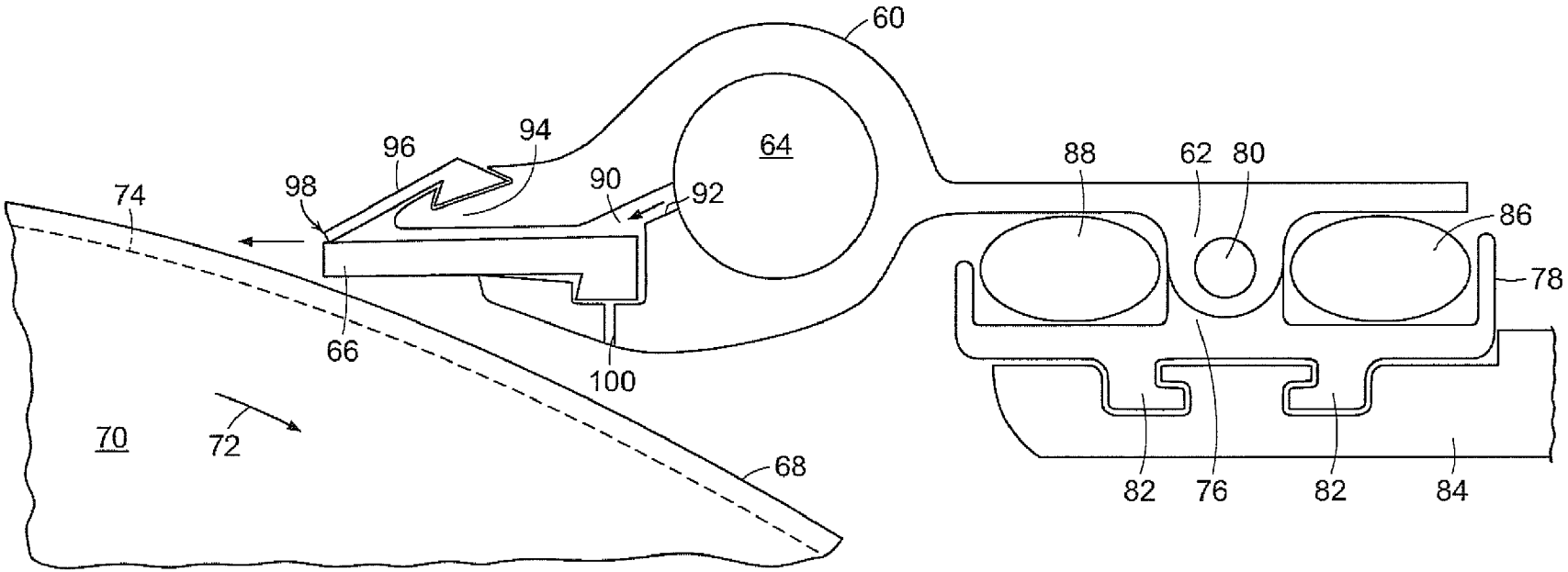
FIG. 2 shows an illustrative diagrammatic view of a doctoring system in accordance with another embodiment of the invention.

FIG. 2 shows a further embodiment of the invention, wherein a doctor blade holder 60 with integral mounting structure 62 includes an integral flow plenum 64, and carries a separate doctor blade 66 that doctors a surface 68 of a roll 70 as the roll rotates in a direction as shown at 72. The surface 68 of the roll 70 may include grooves as shown at 74. The integrally formed mounting structures 62 are coupled to integrally formed mounting structures 76 on a tube tray 78 by a rod 80. The tube tray 78 may also include integral doctor-back mounting structure 82 for coupling to a doctor-back 84. Loading tubes 86 and 88 are used to position the blade 66 against the surface 68 of the roll 70 as discussed above with reference to loading tubes 20, 22 of FIG. 1.

The holder 60 may be a fiber reinforced pultrusion or metallic extrusion. Air under pressure enters the plenum 64, and then feeds into an intermediate plenum 90 through an aperture 92. The aperture 92 may comprise either a series of holes or a continuous slot opening. A forward region 94 of the holder 60 carries a spring loaded flapper spring 96 (for example, formed of a synthetic or metallic material) that is preloaded against the blade 66. The preloaded flapper spring 96 may be formed of an elongated shape that is received within a complementary elongated shaped recess within the doctor blade holder as shown. In the absence of pressure, a gap at the exit 98 is closed, preventing contaminants from entering during a machine outage. Pressure within intermediate plenum 90 exerts an upward force on the flapper 96, creating a gap at that exit 98. Air flows in the direction of exit 98, and a communication port 100 that is in communication with ambient pressure ensures that a net downward force on the rear portion of blade 66 secures the blade in a stable manner within the holder 60. The blade 66 is also stabilized by providing the wedge-shaped geometry as shown.

Figure 3:
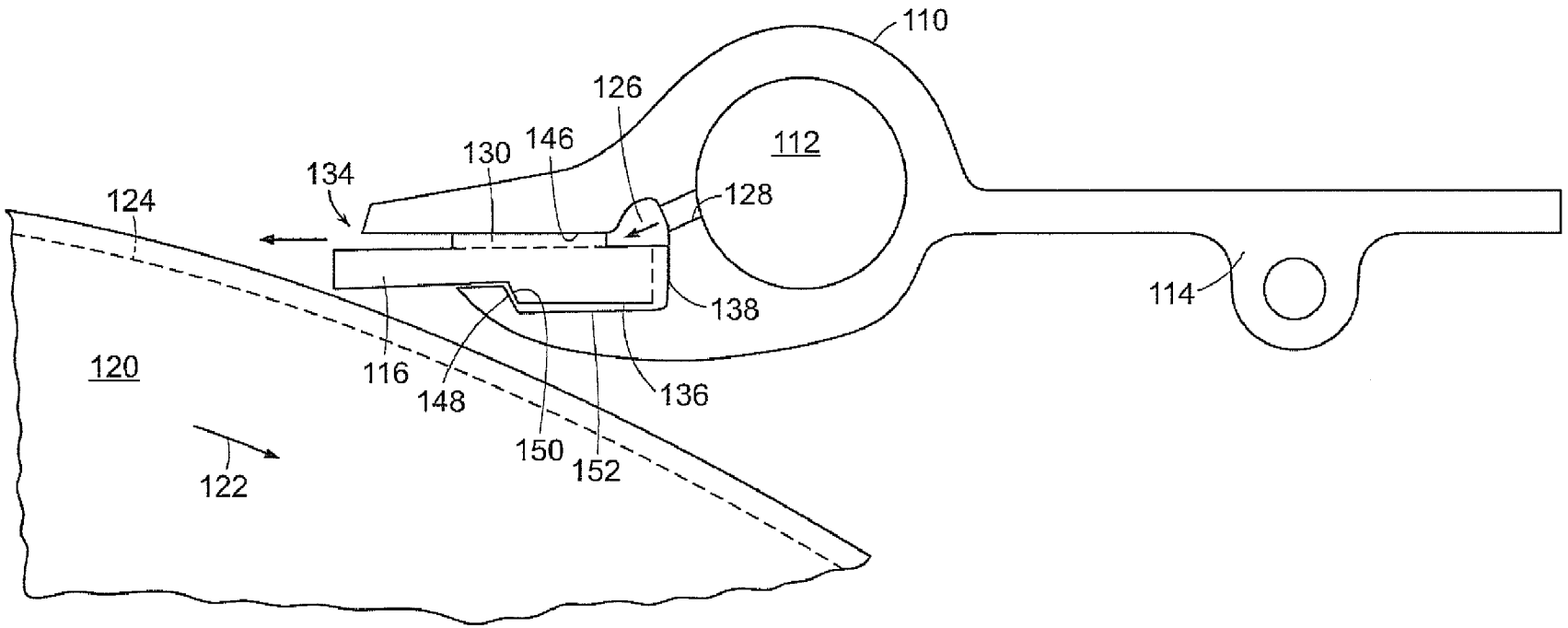
FIG. 3 shows an illustrative diagrammatic view of a doctoring system in accordance with a further embodiment of the invention.
Figure 4:
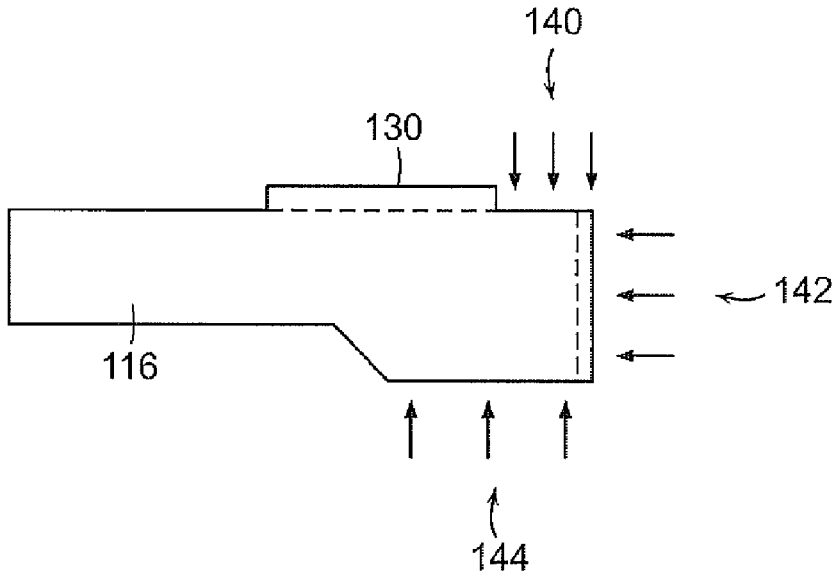
FIG. 4 shows an illustrative diagrammatic view of the doctor blade of the doctoring system of FIG. 3.
Figure 5:
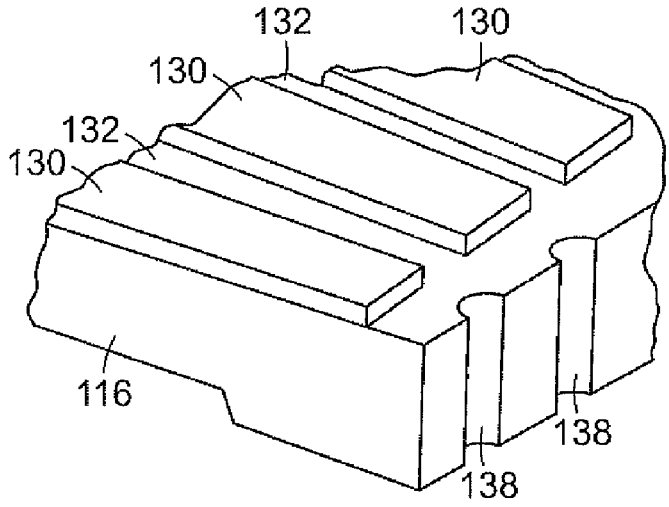
FIG. 5 shows an illustrative diagrammatic view of a portion of the doctor blade of FIG. 3.

FIGS. 3-5 show a further embodiment of the invention in which the primary function of the integral flow plenum and discharge is to create a high momentum jet of air and to direct it at the body of water that resides in roll grooves, such to deflect the water outwardly from the grooves to a suitable location on the paper machine. In particular, a reinforced fiber pultruded holder 110 includes an internal plenum 112 and is coupled to a tube tray via a plurality of integrally formed mounting structures 114 as discussed above with reference to FIGS. 1 and 2. The holder 110 carries a separate doctor blade 116 that is situated and held stable within the holder 110 by air pressure, and the doctor blade 116 is for cleaning a surface 118 of a roll 120 as it rotates in a direction as shown at 122. The roll 120 may include grooves as shown at 124.

Air under pressure enters the plenum 112, and then feeds into an intermediate plenum 126 through an aperture 128 that may be formed as a series of holes or a continuous slot opening. The intermediate plenum 126 is generally formed by geometric features of the holder 110. In accordance with other embodiments, the intermediate plenum may be defined more by geometric features in the blade, as discussed further below with reference to FIG. 6. As further shown in FIG. 5, the doctor blade 116 includes lands 130 and lower portions 132, and air flows through the channels (e.g., having a height of about 0.005 inches to about 0.015 inches) thus formed by the lower portions 132 to an exit region 134 of the holder 110 where it is discharged at an exit gap of as discussed above.

Figure 7:
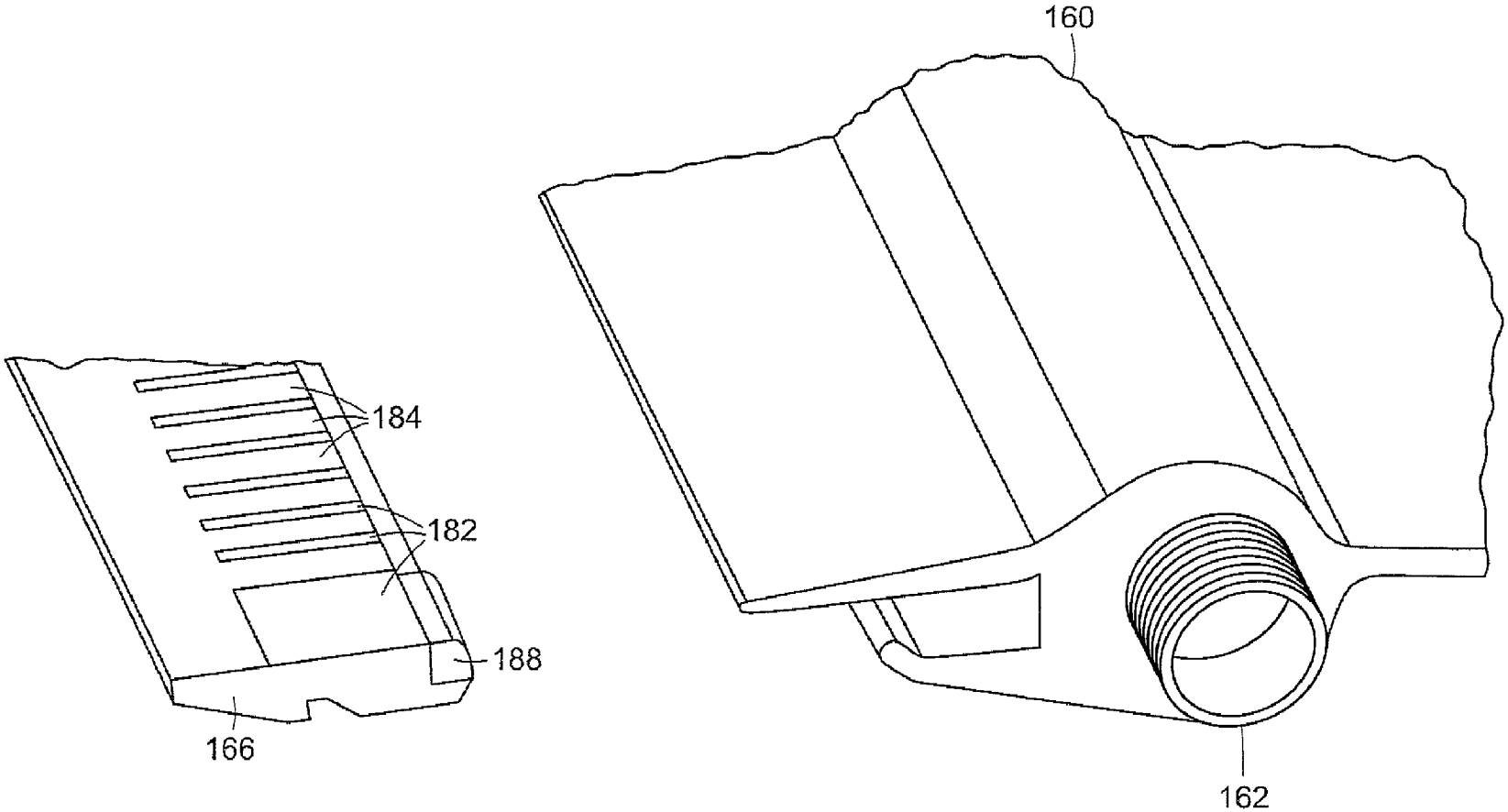
FIG. 7 shows an illustrative diagrammatic exploded view of a doctor blade and a doctor blade holder in accordance with an embodiment of the invention.

The blade 116 is also designed to communicate pressure of the intermediate plenum 126 along a clearance path into a region 136 under the blade 116. The clearance path may in an example be provided by grooves 138 that are formed in the back edge of the doctor blade as shown in FIG. 5. This pressure then acts against the blade 116 with forces as generally shown at 140, 142 and 144. This force distribution, along with the very low pressure of high velocity air within channels formed by the lower regions 132, creates a force balance on the blade 116 that pushes the blade 116 upward against the adjacent surface of the holder as shown at 146, and pushes the blade 116 horizontally against a surface of the wedge region 148 of the holder 110. These forces lock and stabilize the doctor blade 116 in place under operating conditions, and preferably create a seal along the entire machine width between the surface 148 of the doctor blade holder 110 and an adjacent surface 150 of the doctor blade 116. End leakage may be minimized by bonding or otherwise including by suitable means such as an end plug as discussed further below with reference to FIG. 7. Any remaining edge clearances are small and any resulting leakage of air is a small percentage of the total device flow rate.

Figure 6:
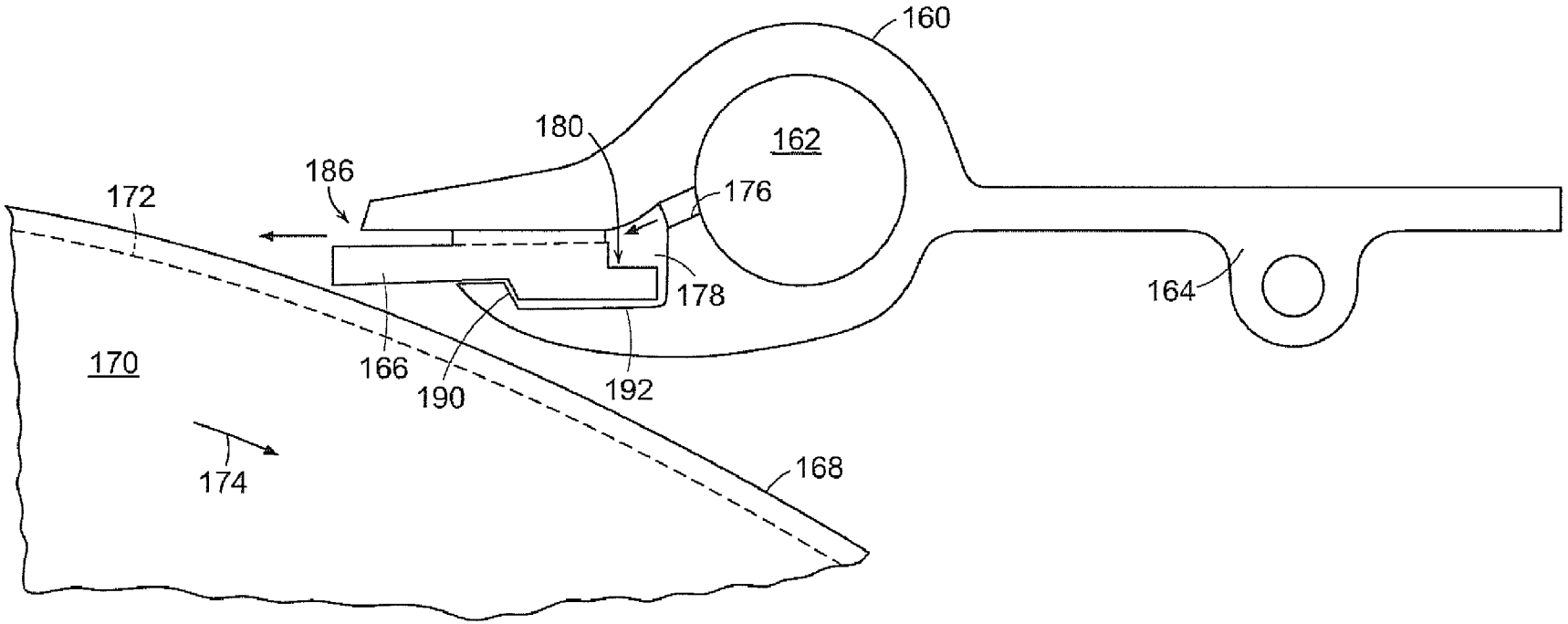
FIG. 6 shows an illustrative diagrammatic view of a doctoring system in accordance with a further embodiment of the invention.

In accordance with a further embodiment of the invention shown in FIG. 6, a doctoring system may include a doctor blade holder 160 that includes an internal plenum 162 and is coupled to a tube tray (not shown) via a plurality of integrally formed mounting structures 164 as discussed above with reference to FIGS. 1 and 2. The doctor blade holder 160 carries a separate doctor blade 166 that is situated and held stable within the holder 160 by air pressure, and the doctor blade 166 is for cleaning a surface 168 of a roll 170 that includes grooves 172 as the roll 170 rotates in a direction as shown at 174.

During use, air under pressure enters the plenum 162, and then feeds through an aperture 176 into an intermediate plenum 178 that is partially formed by a recess in the blade as shown at 180. The doctor blade 166 includes lands 182 and lower portions 184 shown in FIG. 7 as discussed above with reference to FIGS. 3-5, and air flows through channels formed by the lower portions 184 to an exit region 186 where it is discharged at a gap as discussed above. The discharged air then creates a high momentum jet of air that is directed toward a body of water that resides in the roll grooves 172 in the surface 168 of the roll 170, such to deflect the water outwardly from the grooves to a suitable location on the paper machine. High pressure air from within intermediate plenum 178 communicates to underside region 192 of the blade 166 via clearance 191. This pressure creates a force balance on the blade 166 that pushes the blade 166 upward against an adjacent surface of the holder, and pushes the blade 166 horizontally against a surface of the wedge region 190 of the holder 110. These forces lock and stabilize the doctor blade 166 in place under operating conditions An end plug 188 (shown in FIG. 7) prevents air from escaping out the sides of the blade 166, which prevents loss of pressure within plenum 178. In certain embodiments, the underside of the blade 166 may be urged against the lower portion of the holder 160 as shown at 192, as discussed further in reference to FIG. 9.

Figure 8:
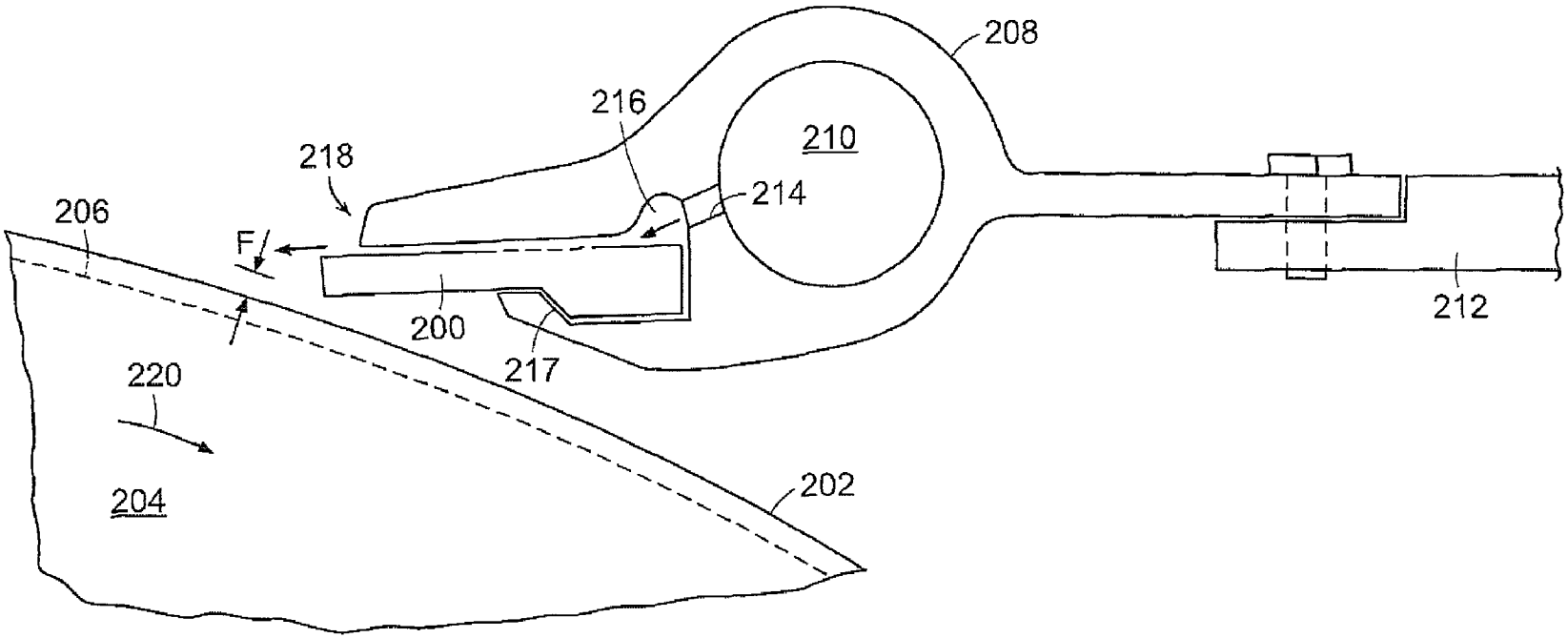
FIG. 8 shows an illustrative diagrammatic view of a doctoring system in accordance with a further embodiment of the invention.

The doctor blade may be in contact with the roll surface as discussed above, or in certain embodiments, the doctor blade may be installed in a gap-set, non-contact mode as shown in FIG. 8. The doctor blade 200 is positioned slightly offset from the surface 202 of the roll 204 (which may include grooves 206), creating a gap as shown at F. The doctor blade 200 is coupled to a doctor blade holder 208 that includes an internal plenum 210 and is mounted directly to a doctor-back 212. Air under pressure enters the plenum 210, and then feeds through an aperture 214 (which may either a series of holes or a continuous slot) into an intermediate plenum 216. Pressure is communicated about the blade 200 in a manner as discussed above, which locks and stabilizes the blade, and preferably seals the blade at 217.

The doctor blade 200 includes lands and lower portions as discussed above with reference to FIGS. 3-5, and air flows through channels formed by the lower portions to an exit region 218 where it is discharged at a gap as discussed above. The discharged air then creates a high momentum jet of air that is directed toward a body of water that resides in roll the grooves 206 in the surface 202 of the roll 204 as the roll 204 rotates in a direction as indicated at 220, such to deflect the water outwardly from the grooves to a suitable location on the paper machine. The blade is a wear element commodity, so that when wear occurs through intentional or unintentional contact with the surface, the blade may be replaced, but replacement of the doctor blade holder is not needed.

Figure 9:
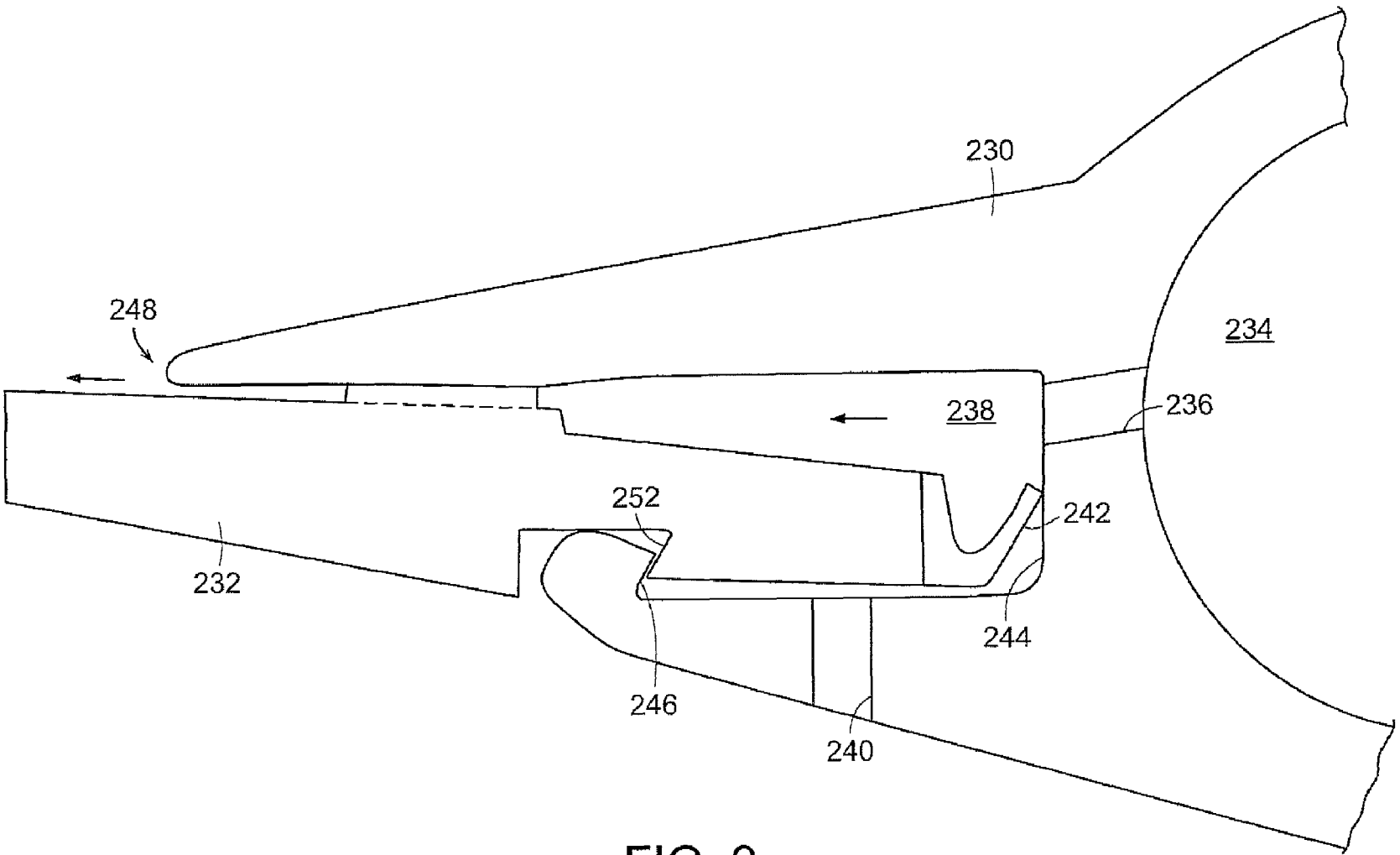
FIG. 9 shows an illustrative diagrammatic view of a doctoring system in accordance with a further embodiment of the invention.
Figure 10:
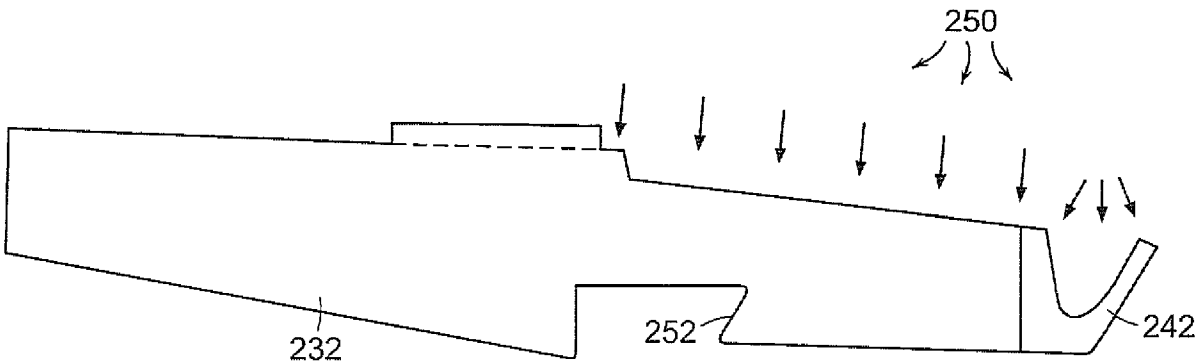
FIG. 10 shows an illustrative diagrammatic view of the doctor blade of the doctoring system of FIG. 9.

In accordance with another embodiment as shown in FIGS. 9 and 10, a doctoring system utilizes pressure to stabilize the doctor blade employing a flexible sealing element. FIG. 9 shows a doctoring system in which a doctor blade holder 230 carries a separate doctor blade 232. The doctor blade holder 230 may be coupled to a doctor-back via an adjustable tube tray as discussed above with reference to FIGS. 1 and 2. Air under pressure enters a plenum 234, and then flows through aperture 236 (which may comprise either a series of holes or a continuous opening) into an intermediate plenum 238. A port 240 communicates ambient pressure to the underside region of the back of the doctor blade 232. A flexible feature 242 on the doctor blade 232 deflects under pressure against an inner wall 244 of the holder 230, sealing the high pressure of plenum 238 from the underside of the blade 232. The flexible feature 242 may be integral with the blade 232, or a separate element bonded to the blade 232. The high pressure within the plenum 238 also acts to secure the blade 232 against a wedge surface 246 of the holder 230.

The doctor blade 232 includes lands and lower portions as discussed above with reference to FIGS. 3-5, and air flows through channels formed by the lower portions to a exit region 248 where it is discharged at a gap as discussed above. The discharged air then creates a high momentum jet of air that is directed toward a body of water that resides in roll grooves in the surface of the roll, such to deflect the water outwardly from the grooves to a suitable location on the paper machine. FIG. 10 shows that the high pressure acts on the blade 232 to provide forces as shown at 250, to seal the blade 232 at the flexible element 242 as well as at the wedge surface 246 of the holder 230 that engages a wedge surface 252 of the doctor blade 232, and situate the blade in a stable position.

Figure 12:
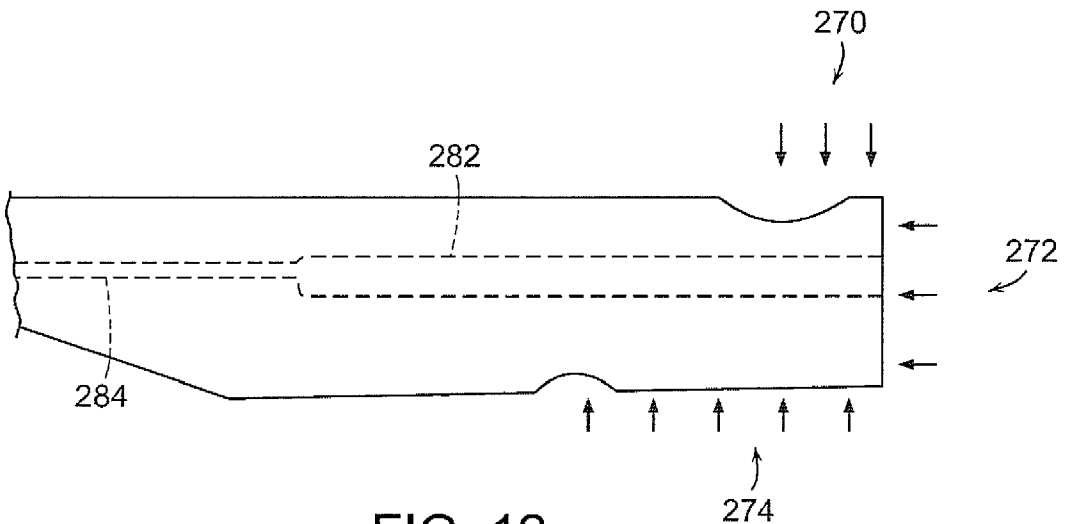
FIG. 12 shows an illustrative diagrammatic view of a portion of the doctor blade of the doctoring system of FIG. 11.
Figure 11:
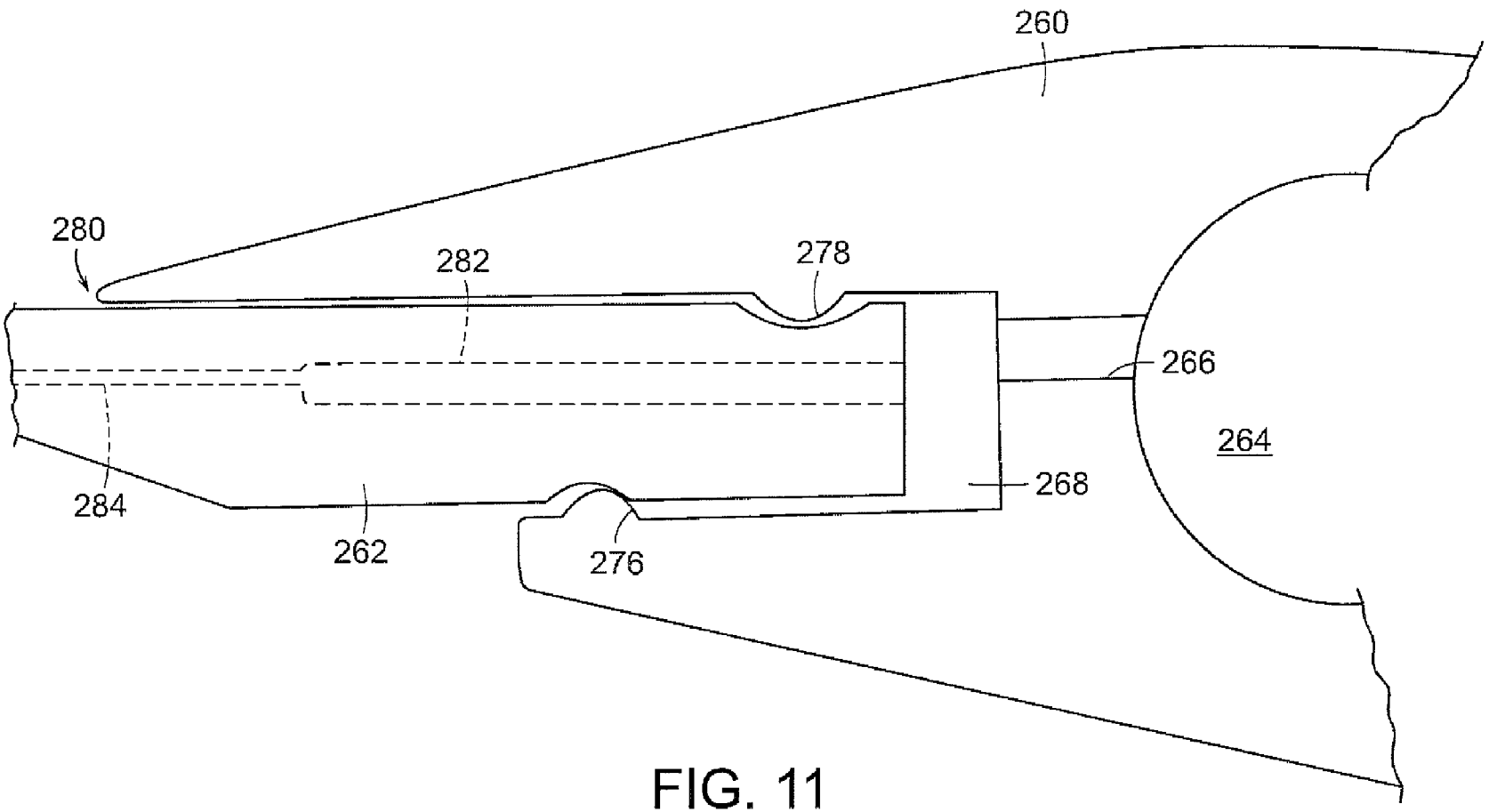
FIG. 11 shows an illustrative diagrammatic view of a doctoring system in accordance with a further embodiment of the invention.

In accordance with another embodiment, and as shown in FIGS. 11 and 12, pressures may be used to situate and stabilize the blade by providing apertures within the blade. In particular, a doctor blade holder 260 carries a separate blade 262, and the doctor blade holder may be coupled to a doctor-back via an adjustable tube tray as discussed above with reference to FIGS. 1 and 2. Air under pressure enters plenum 264, then flows through aperture 266 (which may be either a series of holes or a continuous slot opening) into intermediate plenum 268. Air pressure acts as shown at 270, 272 and 274 in FIG. 12 to urge the blade 532 horizontally against bottom standoff 276 and top standoff 278 on the blade holder 260 as shown. Air pressure also causes the blade to be tipped upward such that a gap at the forward end of the blade 262 is sealed as shown at 280. These forces situate and stabilize the blade within the holder. Air is also sealed at bottom standoff 276 and the top standoff 278.

Air within plenum 268 flows along a plurality of paths 282 within the blade 262; this flow path is contained entirely within the blade itself, rather than formed by surfaces of both blade and holder as in prior embodiments. The air then discharges from paths 282, and enters a final region 284, which may be provided as a plurality of channels or a continuous slot. The high pressure air then exits the blade at an output end for cleaning a grooved surface of a roll or other moving surface in a papermaking machine.

The pressure-stabilized blades of these embodiments are manufactured with sufficient clearances with respect to the holder, such to facilitate ease of installation of the blade into the holder. Alternatively, the blade could be designed and manufactured with little clearance or slight interference, therefore not needing to rely on pressure to keep the blade stable, but with the penalty of making installation difficult.

Those skilled in the art will appreciate that numerous modifications and variations may be made to the above disclosed embodiments without departing from the spirit and scope of the invention.

What is claimed is:

1. A doctoring system for cleaning a surface in a papermaking machine, said doctoring system comprising:

a doctor blade coupled to a doctor blade holder, said doctor blade holder being coupled to a doctor-back; and fluid assist means for providing a fluid under positive pressure that is higher than atmospheric pressure, said fluid being directed in a direction generally opposite a direction of movement of the moving surface such that fluid of high momentum is provided to impinge on water resident within the moving surface and adjacent a leading edge of the doctor blade during movement of the moving surface, wherein the fluid is provided through at least one opening in the doctor blade holder, said opening including means for maintaining a constant opening size in response to the positive pressure of the fluid.

2. The doctoring system as claimed in claim 1, wherein said doctor blade holder is formed of a pultruded material.

3. The doctoring system as claimed in claim 1, wherein said pultruded material includes a composite of fiber and polymeric resin.

4. The doctoring system as claimed in claim 1, wherein said fluid under positive pressure is provided from a plenum within the doctor blade holder.

5. The doctoring system as claimed in claim 4, wherein said plenum is defined by walls that are formed integrally with the doctor blade holder.

6. The doctoring system as claimed in claim 1, wherein said doctoring system includes separate doctor blade and blade holder structures, permitting doctor blades to be attached and removed in the doctoring system without affecting the fluid assist means.

7. The doctoring system as claimed in claim 1, wherein said fluid under positive pressure is provided from a plenum via the at least one opening, wherein the at least one opening comprises an elongated aperture in the forward part of the doctor blade holder and doctor blade.

8. The doctoring system as claimed in claim 7, wherein said elongated aperture is formed by the deflection of a forward flapper that is attached to the blade holder.

9. The doctoring system as claimed in claim 8, wherein the forward flapper is preloaded against the doctor blade, thus sealing the plenum from external contaminants during a machine outage.

10. The doctoring system as claimed in claim 7, wherein said aperture is formed by the deflection of a separate flapper spring component from the doctor blade holder.

11. The doctoring system as claimed in claim 10, wherein the flapper spring component is preloaded against the doctor blade, thus sealing the plenum from external contaminants during a machine outage.

12. The doctoring system as claimed in claim 1, wherein the fluid under positive pressure further provides force on the doctor blade that stabilizes the doctor blade within the doctor blade holder.

13. The doctoring system as claimed in claim 1, wherein said fluid under pressure is provided from a plenum via the at least one opening, wherein the at least one opening is one of a series of holes in the doctor blade holder that communicate with a series of channels provided in the doctor blade.

14. The doctoring system as claimed in claim 1, wherein said fluid under pressure is provided from a plenum via the at least one opening, wherein the at least one opening is one of a series of holes in the doctor blade holder that communicate with a series of holes formed into the doctor blade.

15. The doctoring system as claimed in claim 1, wherein said doctor blade holder includes a plurality of mounting structures disposed along at least a portion of an elongated length of a doctor blade, and wherein said mounting structures facilitate pivotally coupling the doctor blade holder to a doctor-back.

16. The doctoring system as claimed in claim 1, wherein said doctor blade is in contact with the moving surface.

17. The doctoring system as claimed in claim 1, wherein said doctor blade is set to a specified distance away from the moving surface.

18. The doctoring system as claimed in claim 1, wherein said fluid under positive pressure further provides force on the doctor blade that urges the doctor blade forward with respect to the doctor blade holder to stabilize the doctor blade within the doctor blade holder.

19. The doctoring system as claimed in claim 18, wherein the force on the doctor blade that stabilizes the doctor blade within the doctor blade holder includes a force acting on a back side of the doctor blade to urge the doctor blade toward the roll surface and against a surface of the doctor blade holder.

20. A doctoring system for a papermaking machine, said doctoring system comprising:

a doctor blade coupled to a doctor blade holder, said doctor blade for cleaning a surface on a roll, and said doctor blade holder being coupled to a doctor-back; and fluid securing means for providing a fluid within a plenum under positive pressure that is higher than atmospheric pressure, to utilize plenum pressure to urge the doctor blade forward with respect to the doctor blade holder to thereby position and stabilize the doctor blade into a fixed position against a forward surface within the doctor blade holder.

21. The doctoring system as claimed in claim 20, wherein said fluid is directed via channels along a top surface of the doctor blade in a direction generally opposite a direction of rotation of the roll such that fluid of high momentum is provided to impinge on water resident in grooves contained in a roll and adjacent a leading edge of the doctor blade during rotation of the roll.

22. The doctoring system as claimed in claim 20, wherein the plenum is provided within the doctor blade holder.

23. The doctoring system as claimed in claim 22, wherein said plenum is defined by walls that are formed integrally with the doctor blade holder.

24. A method of cleaning a moving surface in a papermaking system, said method comprising the steps of:

coupling a doctor blade to a doctor blade holder and coupling said doctor blade holder to a doctor-back; and providing a fluid within a plenum under positive pressure that is higher than atmospheric pressure, to utilize plenum pressure to position and stabilize the doctor blade into a fixed position against surfaces of the doctor blade holder, while also directing the fluid under positive pressure in a direction generally opposite a direction of movement of the moving surface such that fluid of high momentum is provided to impinge on water resident within the moving surface and adjacent a leading edge of the doctor blade during movement of the moving surface, wherein the step of providing the fluid within the plenum under positive pressure includes providing the fluid through at least one opening formed between the doctor blade holder and a pre-loaded spring, wherein the at least one opening is maintained substantially constant in size due to the positive pressure of the fluid.

25. The method as claimed in claim 24, wherein said fluid under positive pressure further provides force on the doctor blade that urges the doctor blade forward with respect to the doctor blade holder to stabilize the doctor blade within the doctor blade holder.

26. The method as claimed in claim 25, wherein the force on the doctor blade that stabilizes the doctor blade within the doctor blade holder includes a force acting on a back side of the doctor blade to urge the doctor blade toward the roll surface.

27. The method as claimed in claim 25, where in said fluid under positive pressure further provides force on the doctor blade that urges the doctor blade upward with respect to the doctor blade holder to further stabilize the doctor blade within the doctor blade holder.

28. The method as claimed in claim 25, where in said fluid under positive pressure that provides force on the doctor blade that urges the doctor blade forward with respect to the doctor blade holder also creates a seal between the doctor blade and the surface of the doctor blade holder against which the doctor blade is urged forward.

29. A doctoring system for cleaning a surface in a papermaking machine, said doctoring system comprising:

a doctor blade coupled to a doctor blade holder, said doctor blade holder being coupled to a doctor-back; and fluid assist means for providing a fluid under positive pressure that is higher than atmospheric pressure, said fluid being directed in a direction generally opposite a direction of movement of the moving surface such that fluid of high momentum is provided to impinge on water resident within the moving surface and adjacent a leading edge of the doctor blade during movement of the moving surface, wherein the fluid is provided through at least one opening in the doctor blade holder, and wherein said fluid under positive pressure further provides force on the doctor blade that urges the doctor blade forward with respect to the doctor blade holder to stabilize the doctor blade within the doctor blade holder.

30. The doctoring system as claimed in claim 29, wherein the force on the doctor blade that stabilizes the doctor blade within the doctor blade holder includes a force acting on a back side of the doctor blade to urge the doctor blade toward the moving surface.

31. The doctoring system as claimed in claim 29, where in said fluid under positive pressure further provides force on the doctor blade that urges the doctor blade upward with respect to the doctor blade holder to further stabilize the doctor blade within the doctor blade holder.

32. The doctoring system as claimed in claim 29, where in said fluid under positive pressure that provides force on the doctor blade that urges the doctor blade forward with respect to the doctor blade holder also creates a seal between the doctor blade and the surface of the doctor blade holder against which the doctor blade is urged forward.

33. The doctoring system as claimed in claim 29, wherein said doctor blade holder is formed of a pultruded material.

34. The doctoring system as claimed in claim 29, wherein said pultruded material includes a composite of fiber and polymeric resin.

35. The doctoring system as claimed in claim 29, wherein said fluid under positive pressure is provided from an integrally formed plenum within the doctor blade holder.

36. The doctoring system as claimed in claim 29, wherein said doctoring system includes separate doctor blade and blade holder structures, permitting doctor blades to be attached and removed in the doctoring system without affecting the fluid assist means.

37. The doctoring system as claimed in claim 29, wherein said fluid under positive pressure is provided from a plenum via the at least one opening, wherein the at least one opening comprises an elongated aperture in the forward part of the doctor blade holder and doctor blade.

38. The doctoring system as claimed in claim 29, wherein said fluid under pressure is provided from a plenum via the at least one opening, wherein the at least one opening is one of a series of holes in the doctor blade holder that communicate with a series of channels provided in the doctor blade.

39. The doctoring system as claimed in claim 29, wherein said fluid under pressure is provided from a plenum via the at least one opening, wherein the at least one opening is one of a series of holes in the doctor blade holder that communicate with a series of holes formed into the doctor blade.

40. The doctoring system as claimed in claim 29, wherein said doctor blade holder includes a plurality of mounting structures disposed along at least a portion of an elongated length of a doctor blade, and wherein said mounting structures facilitate pivotally coupling the doctor blade holder to a doctor-back.

* * * * *